US011626679B1

(12) United States Patent
Ge

(10) Patent No.: US 11,626,679 B1
(45) Date of Patent: Apr. 11, 2023

(54) POWER DISTRIBUTION TERMINAL

(71) Applicant: Weidmüller Interface GmbH & Co. KG, Detmold (DE)

(72) Inventor: Xuefeng Ge, Henrico, VA (US)

(73) Assignee: Weidmüller Interface GmbH & Co.

( * ) Notice: Subject to any disclaimer, the term of this patent is extended or adjusted under 35 U.S.C. 154(b) by 0 days.

(21) Appl. No.: 17/549,125

(22) Filed: Dec. 13, 2021

(51) Int. Cl.
*H01R 13/207* (2006.01)
*H01R 13/627* (2006.01)
*H01R 13/512* (2006.01)

(52) U.S. Cl.
CPC ..... *H01R 13/207* (2013.01); *H01R 13/512* (2013.01); *H01R 13/6277* (2013.01)

(58) Field of Classification Search
CPC H01R 13/207; H01R 13/512; H01R 13/6277; H01R 9/24; H01R 9/2408; H01R 9/2608; H01R 13/514
See application file for complete search history.

(56) References Cited

U.S. PATENT DOCUMENTS 7,862,389 B2 * 1/2011 Pizzi ..... H01R 4/28 439/709
8,632,355 B2 * 1/2014 Hartmann ..... H01R 4/4845 439/411
9,667,005 B2 * 5/2017 Pizzi ..... H01R 25/142

OTHER PUBLICATIONS

Combined Machine Translation and Original Document DE 202012103985 U1 (Feb. 5, 2014) (Year: 2022).*

* cited by examiner

*Primary Examiner* — Travis S Chambers
(74) *Attorney, Agent, or Firm* — Laubscher PC

(57) ABSTRACT

A modular power distribution terminal includes an outer housing containing a chamber and a bottom opening. The outer housing includes a top wall, a pair of spaced end walls and a pair of spaced parallel side walls having first fasteners. At least one module slice is arranged in the outer housing chamber and includes a slice housing including a pair of spaced parallel side walls having first fasteners configured for fastening with the first fasteners of one of the outer housing side walls and a current bar connected with and extending along a length of the slice housing. An input screw connection terminal and at least two output push-in connection terminals are connected with the current bar.

13 Claims, 9 Drawing Sheets

POWER DISTRIBUTION TERMINAL

BACKGROUND OF THE INVENTION

The present invention relates to a power distribution terminal. Such terminals are known in the art and typically utilize at least two copper layers which provide a plurality of input and output connections for the terminal.

While such terminals operate satisfactorily, should there be damage or a fault in one of the connectors, the entire terminal must be replaced. Thus, there is a need for a power distribution terminal which includes a plurality of similar terminal modules or slices which can be manually interconnected to define a terminal assembly. Should there be a fault in one of the modules, it can easily be replaced without disrupting or replacing the other modules of the assembly.

SUMMARY OF THE INVENTION

Accordingly, it is a primary object of the invention to provide a modular power distribution terminal which includes an outer housing containing a chamber and at least one module slice arranged with the housing chamber. Each module slice in turn includes its own housing including a pair of spaced parallel side walls which have first fasteners adjacent a lower edge and configured for fastening with the fasteners of the outer housing and with an adjacent slice housing. A current bar is connected with each slice housing and extends along the length thereof. An input screw connection terminal and at least two output push-in connection terminals are connected with the current bar. The input screw connection terminal is accessible from a side orientation while the output push-in connection terminals are accessible from a top orientation via openings in the outer housing top wall.

The slice housing side walls include spaced second fasteners for connection with second fasteners of an adjacent slice module. The second fasteners may be tongue and groove fasteners or dovetail fasteners.

According to a further object of the invention, the push-in connectors include spring elements. Preferably, the spring elements of at least two output terminals have different cross-sections for receiving different conductors, respectively.

In a multi-module terminal, the outer housing preferably includes spaced side walls at least one partition wall parallel to and spaced from the outer housing side walls to divide the chamber into separate chambers each configured to receive a module slice.

BRIEF DESCRIPTION OF THE FIGURES

Other objects and advantages of the invention will become apparent from a study of the following description when viewed in the light of the accompanying drawing, in which.

DETAILED DESCRIPTION

Figure 1:
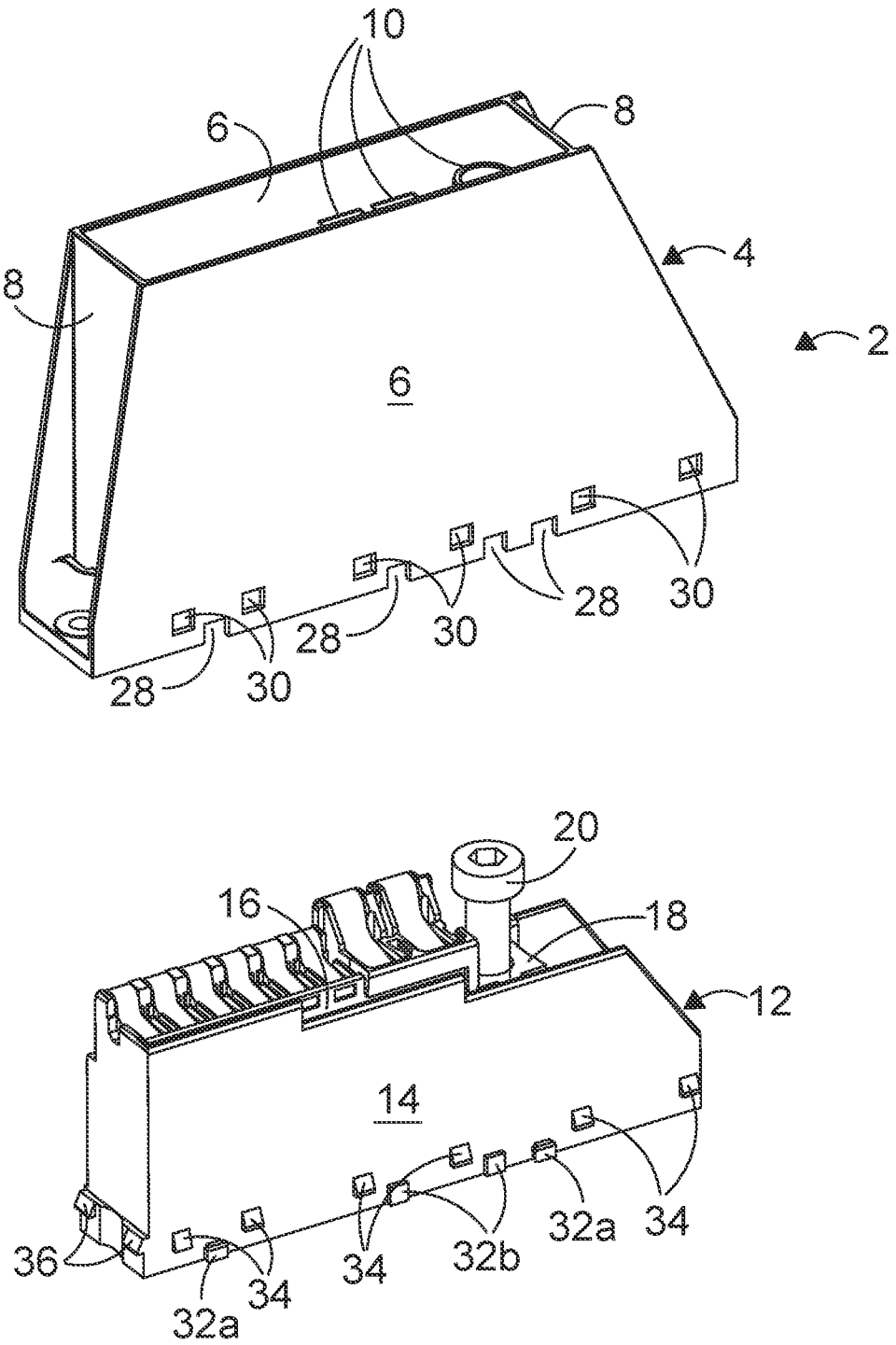
FIG. 1 is an exploded front perspective view modular power distribution terminal according to a first embodiment of the invention.

Referring first to FIG. 1, a single pole or module power distribution terminal 2 is shown. It includes an outer housing 4 having spaced parallel side walls 6 connected between spaced parallel end wall 8 and a top wall containing a plurality of openings 10. The outer housing is preferably formed of a synthetic plastic material and is open at the bottom for receiving a module slice 12. Preferably, the outer housing and module slice have a generally rectangular configuration.

Figure 2:
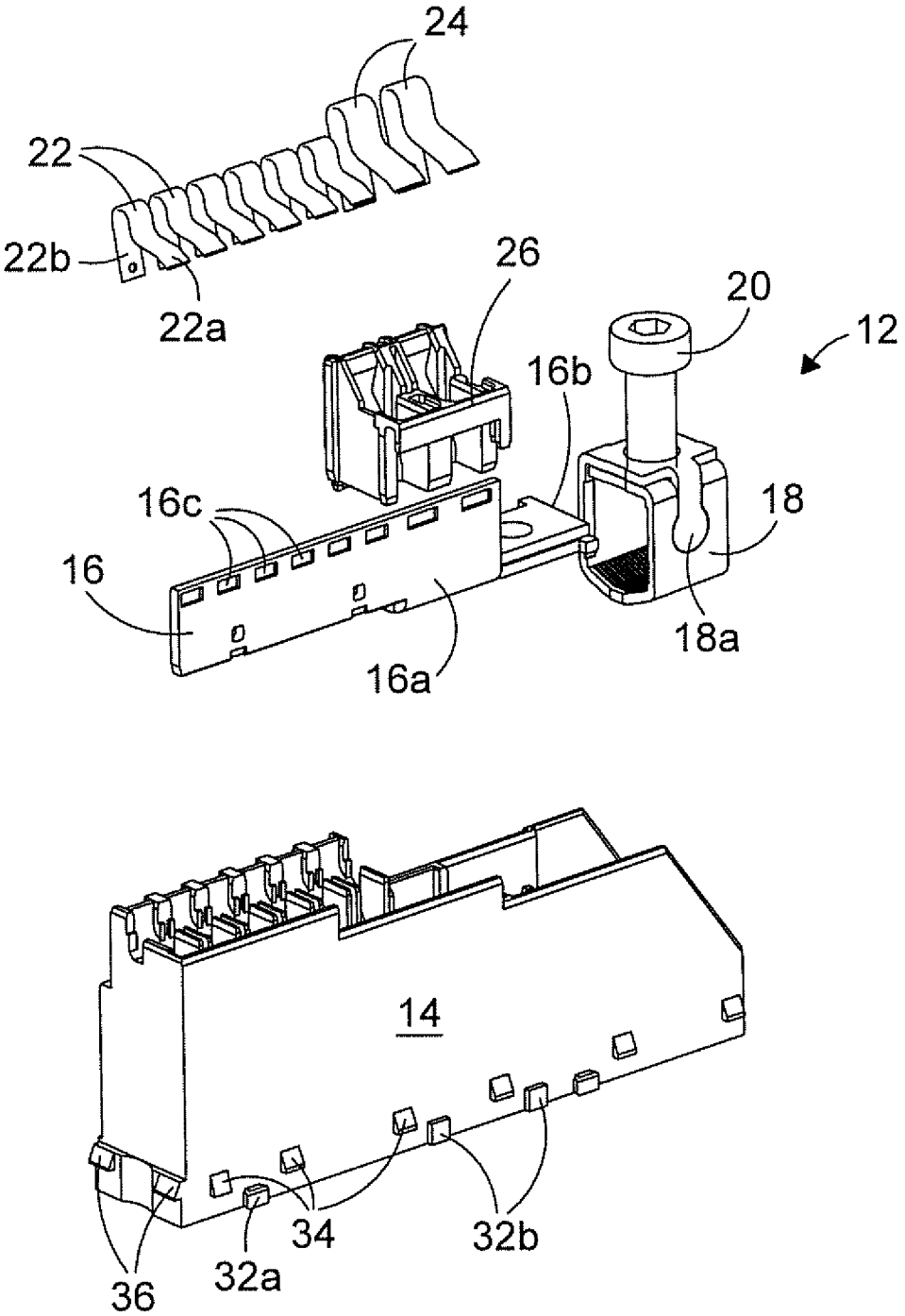
FIG. 2 is an exploded front perspective view of interior components of the terminal of FIG. 1.
Figure 3:
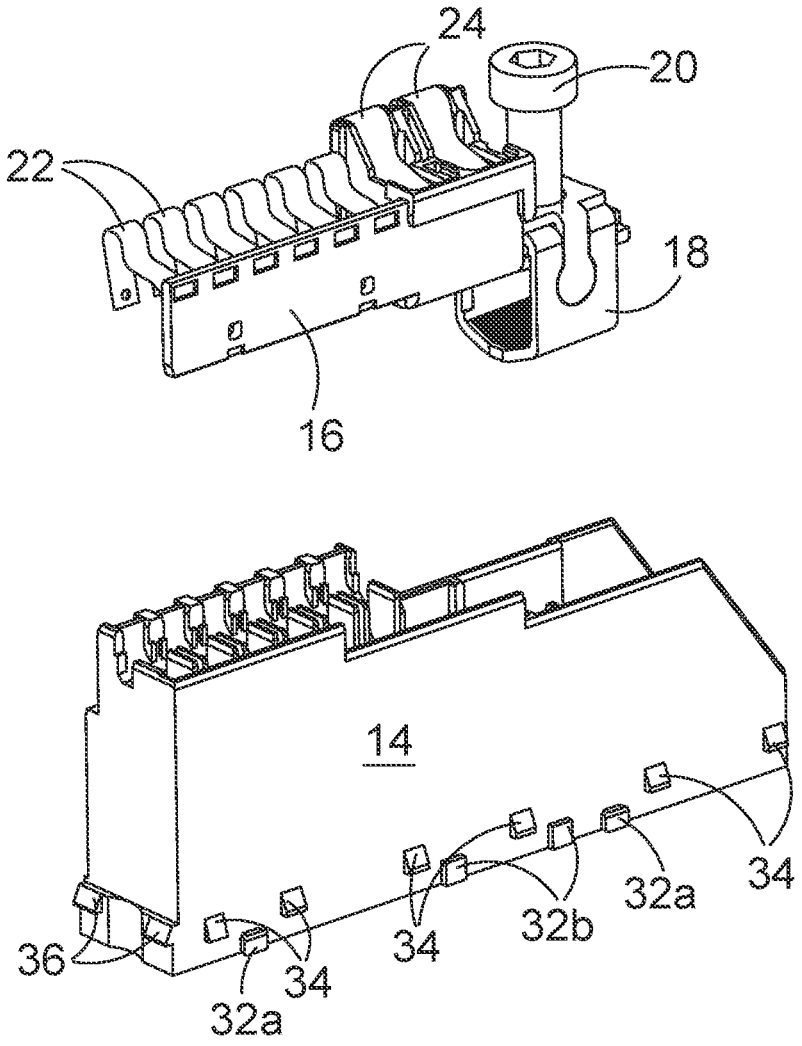
FIG. 3 is an exploded front perspective view of the terminal of FIG. 1 in a partially assembled condition.
Figure 4:
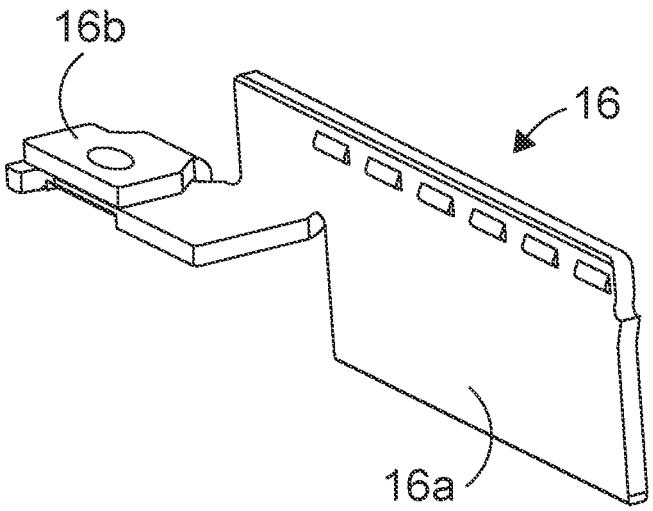
FIG. 4 is a perspective view of the current bar of the terminal of FIGS. 1-3.
Figure 5:
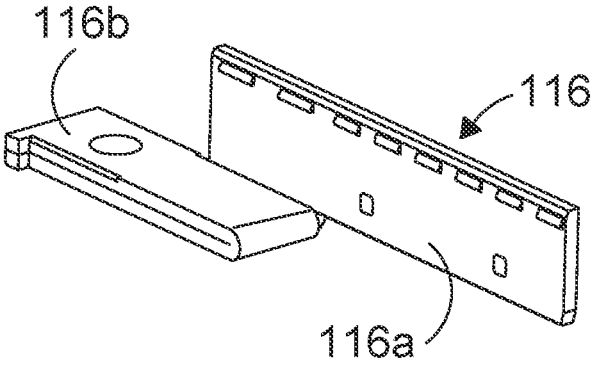
FIG. 5 is a perspective view of an alternate embodiment of the current bar.

The module slice 12 is shown more particularly in FIGS. 2 and 3. It includes an outer slice housing 14 which is preferably formed on a synthetic plastic material. The slice housing contains a current bar 16 which extends generally along the length of thereof. The current bar is preferably formed of a conductive metal such as copper and includes a first portion 16*a* having a generally vertical orientation which is retained in a receptacle of the housing and a second portion 16*b* having a generally horizontal orientation which is bent relative to the first portion or vice versa. The bent current bar is shown in greater detail in FIG. 4. In an alternate embodiment shown in FIG. 5, the current bar 116 bar is formed in two pieces 116*a* and 116*b* which are joined together such as by soldering.

Input and output connection terminals are connected with the current bar. The input connection terminal is preferably of the screw type and includes a cage 18 arranged in the slice housing 14 and configured to receive the second portion 16*b* of the current bar. Preferably, the second portion 16*b* of the current bar is thicker than the first portion 16*a* because A screw 20 is threadably connected with cage for displacement in and out of the cage relative to the current bar second portion 16*b*. The cage includes a side or lateral opening 18*a* configured to receive the end of a conductor such as a wire. With the end of a wire conductor arranged in the cage opening, the screw is operated from above and rotated into the cage to press the wire end against the second portion 16*b* of the current bar. The second portion 16*b* of the current bar is preferably thicker than the first portion 16*a* because of the higher current provided from the input wire.

The output connection terminals are preferably of the push-in connection type. More particularly, the output connection terminals are formed of resilient metal spring elements 22 each having a first portion 22*a* which is connected with the first portion 16*a* of the current bar and a second portion 22*b* which abuts against the slice housing. More particularly, the current bar first portion 16*a* contains a plurality of spaced openings 16*c* adjacent an upper edge of the current bar, with each opening being configured to receive and retain the end of the spring element first portion 22*a*. A conductor (not shown) may be connected with each output connection terminal by pushing an end of each conductor between the second portion 22*b* of the spring element and the slice housing 14 to retain the conductor end in the housing and establish an electrical connection. Alternatively, the conductor may be pushed into the output connection terminal by a push-in element. The spring element may also be formed with a clamping force to provide a snap-in connection similar to a mouse trap. In lieu of individual conductors connected with the output connection terminals, a functional unit (not shown) including a plurality of pin or prong conductors extending from a bottom portion of the unit may be connected with the spring elements, respectively, via a push-in connection. That is, each pin or prong of the unit is pushed inwardly between the second portion 22*b* of a spring element and the slice housing to retain the conductors of the functional unit within the slice housing and to establish an electrical connection with the current bar. As noted above, the current bar first portion 16*a* is thinner than the second portion 16*b* for smooth current flow between the input and output slice.

In a preferred embodiment, spring elements of different configurations are provided for push-in connectors for receiving differently configured conductors. Thus, the module slice 12 also includes spring elements 24 arranged in a spring holder 26 which is connected with the slice housing 14. The ends of first portions 24*a* of the spring elements 24 are connected with openings 16*c* in the current bar first portion 16*a* and the second portions 24*b* press against an inner wall of the spring holder 26. Conductors are pushed into the spring holder between the holder and the second portions 24*b* of the spring elements 24 which retain the conductors in the spring holder and establish an electrical connection of the conductors with the current bar.

As shown in FIG. 3, the current bar 16, spring elements 22 and 24, and the input cage 18 and screw 20 may be pre-assembled as a unit then inserted from above into the slice housing 14 for connection with the housing such a through a snap-fit connection. The entire combination forms the module slice 12 for the power distribution terminal 2.

Referring once again to FIG. 1, the outer housing 4 of the power distribution terminal 2 includes a plurality of spaced recesses 28 in the lower edge of each side wall 6 for purposes to be discussed below. In addition, a plurality of spaced openings 30 are also provided in each side wall. Preferably, the openings are longitudinally spaced and out of vertical alignment with the recesses 28 as shown.

In addition, the bottom edge of side walls of the slice housing 14 includes a plurality of spaced connectors 32*a*, 32*b* for connection with connectors of an adjacent slice housing as will be discussed below. The connectors 32*a*, 32*b* are aligned with the spaced recesses 28 of the outer housing so that the connectors 32*a*, 32*b* are received by the corresponding recesses 20 when the outer housing is placed over the slice housing with the module slice 12 arranged in the chamber of the outer housing. Spaced projections 34 are provided on the slice housing outer surface. The projections 34 are aligned with the openings 30 in the outer housing side walls 6 for engagement with the openings to connect the outer housing with the splice housing via a snap fit connection. Additional projections 36 may be provided on the end walls of the module slice 12 for connection with openings (not shown) in the outer housing 4. Collectively, the outer housing openings 30 and the slice housing projections 34, 36 define first fasteners for connecting the slice module 12 with the outer housing 4.

Figure 6:
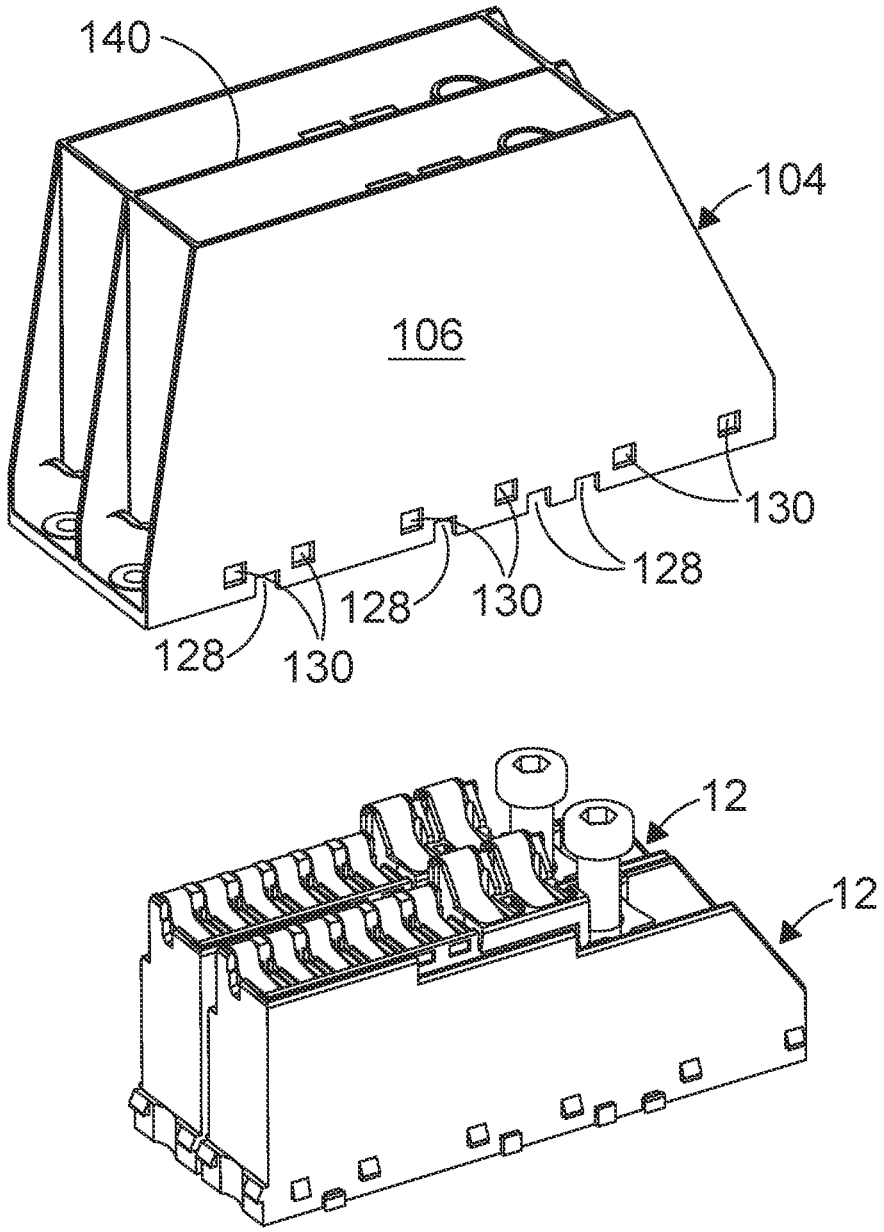
FIG. 6 is an exploded front perspective view of a modular power distribution terminal according to a second embodiment of the invention.

In FIG. 6, an alternate embodiment of a modular power distribution terminal 102 is shown in which two module slices 12 are provided. In this embodiment, the outer housing 104 contains an inner partition wall 140 parallel to and equally spaced between the side walls to divide the chamber within the housing into two chambers, each of which is configured to receive a module slice 12 which are the same as the module slice 12 described above with reference to FIGS. 1-3. The outer housing also contains recesses 128 to accommodate the connectors 32*a*, 32*b* and openings 130 which cooperate with projections 34 on the module slices to connect and retain the module slices within the respective chambers.

Figure 7:
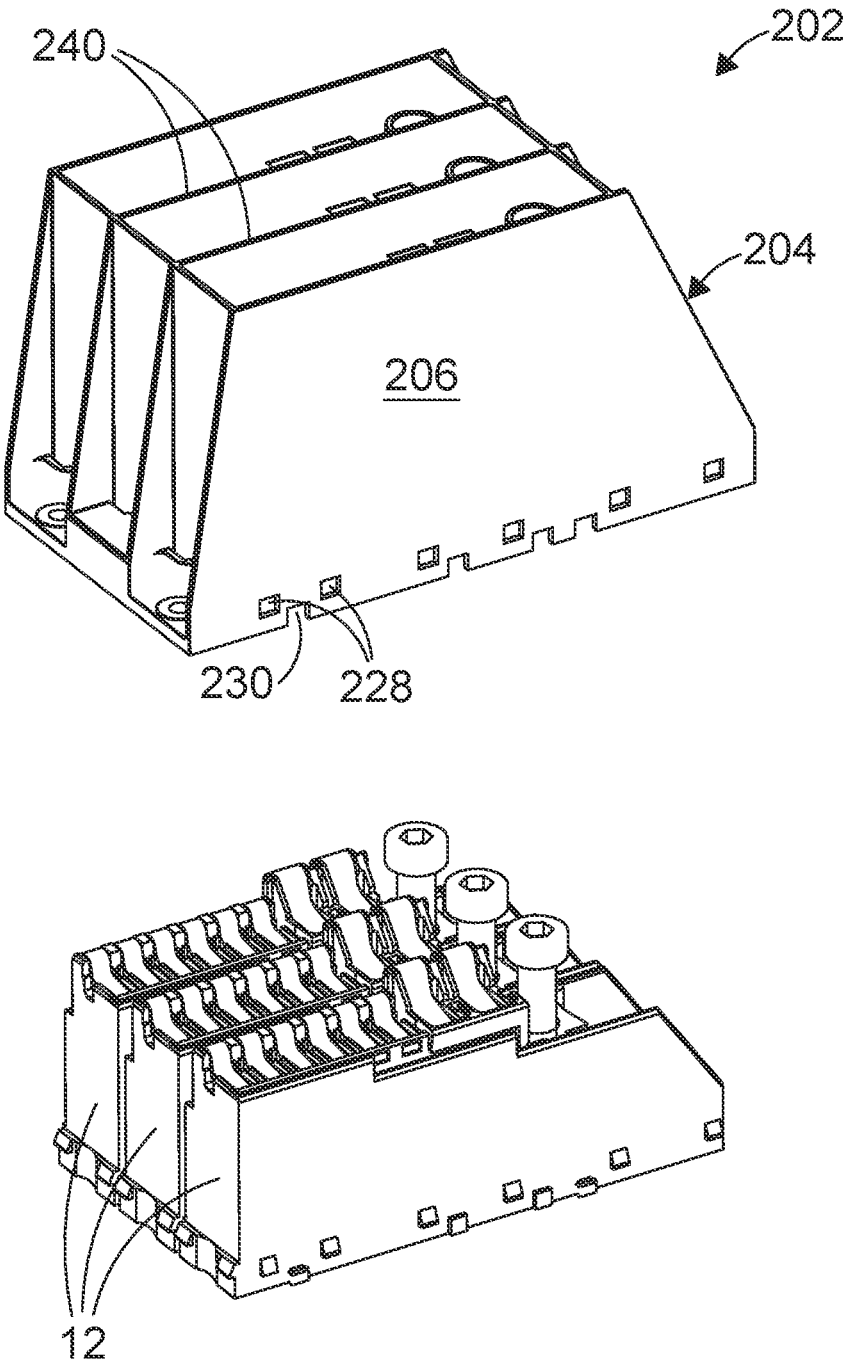
FIG. 7 is an exploded front perspective view of a modular power distribution terminal according to a third embodiment of the invention.

Similarly, FIG. 7 shows a further embodiment of a modular power distribution terminal 202 is shown in which three module slices 12 are provided. In this embodiment, the outer housing 204 contains two inner partition walls 240 parallel to and equally spaced between the side walls to divide the chamber within the housing into three chambers, each of which is configured to receive a module slice 12. The outer housing also contains recesses 228 to accommodate the connectors 32*a*, 32*b* and openings 230 which cooperate with projections 34 on the module slices to connect and retain the module slices within the respective chambers.

Figure 8:
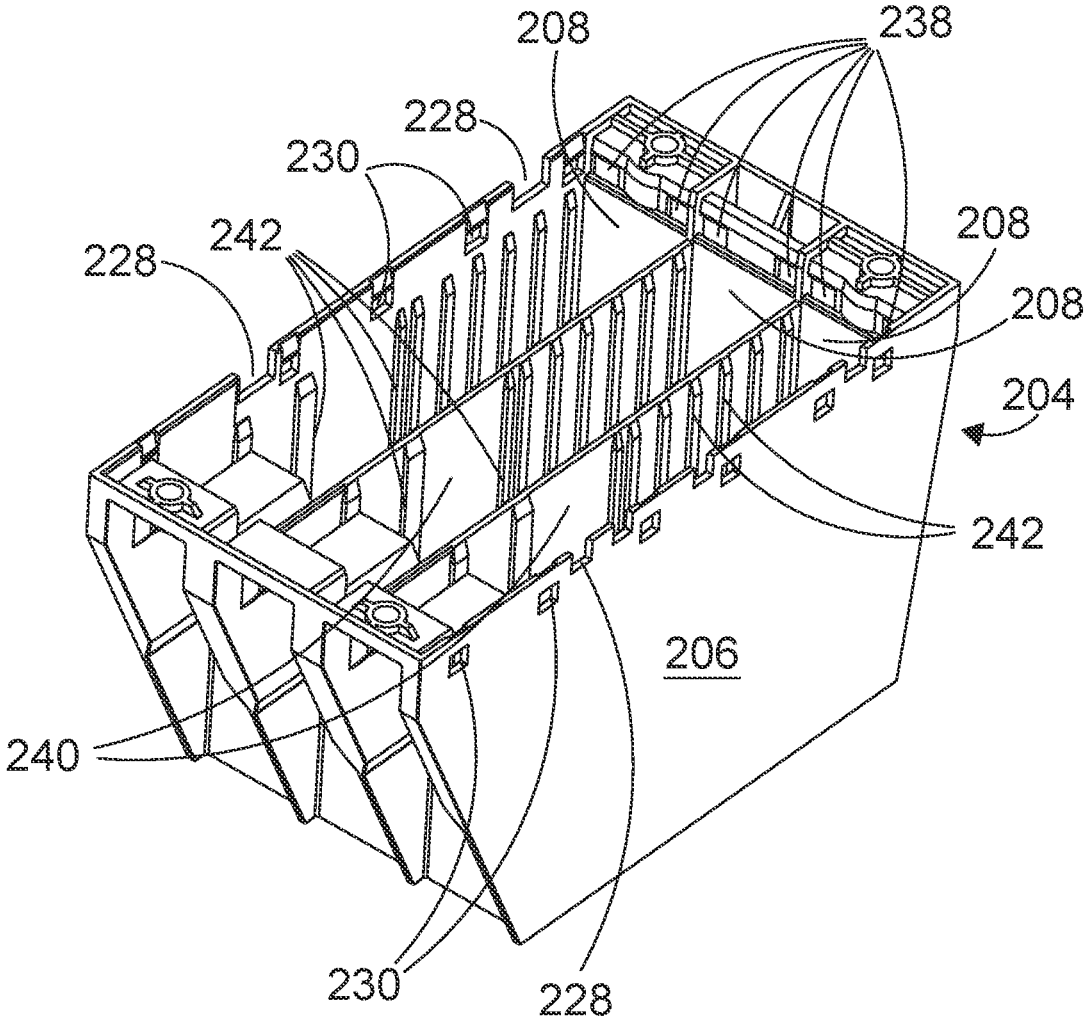
FIG. 8 is a bottom rear perspective view of a housing of the terminal of FIG. 5 prior to insertion of the module slices.

FIG. 8 is a bottom perspective view of the outer housing 204 of the embodiment shown in FIG. 7. The side walls of the 206 of the housing includes the spaced recesses 228 in the lower edges and spaced openings 230, some of which are shown in FIG. 7. In addition, the end walls 208 contain spaced openings 238 which are configured to receive the spaced projections 36 on the end walls of the slice housing 14.

Figure 9:
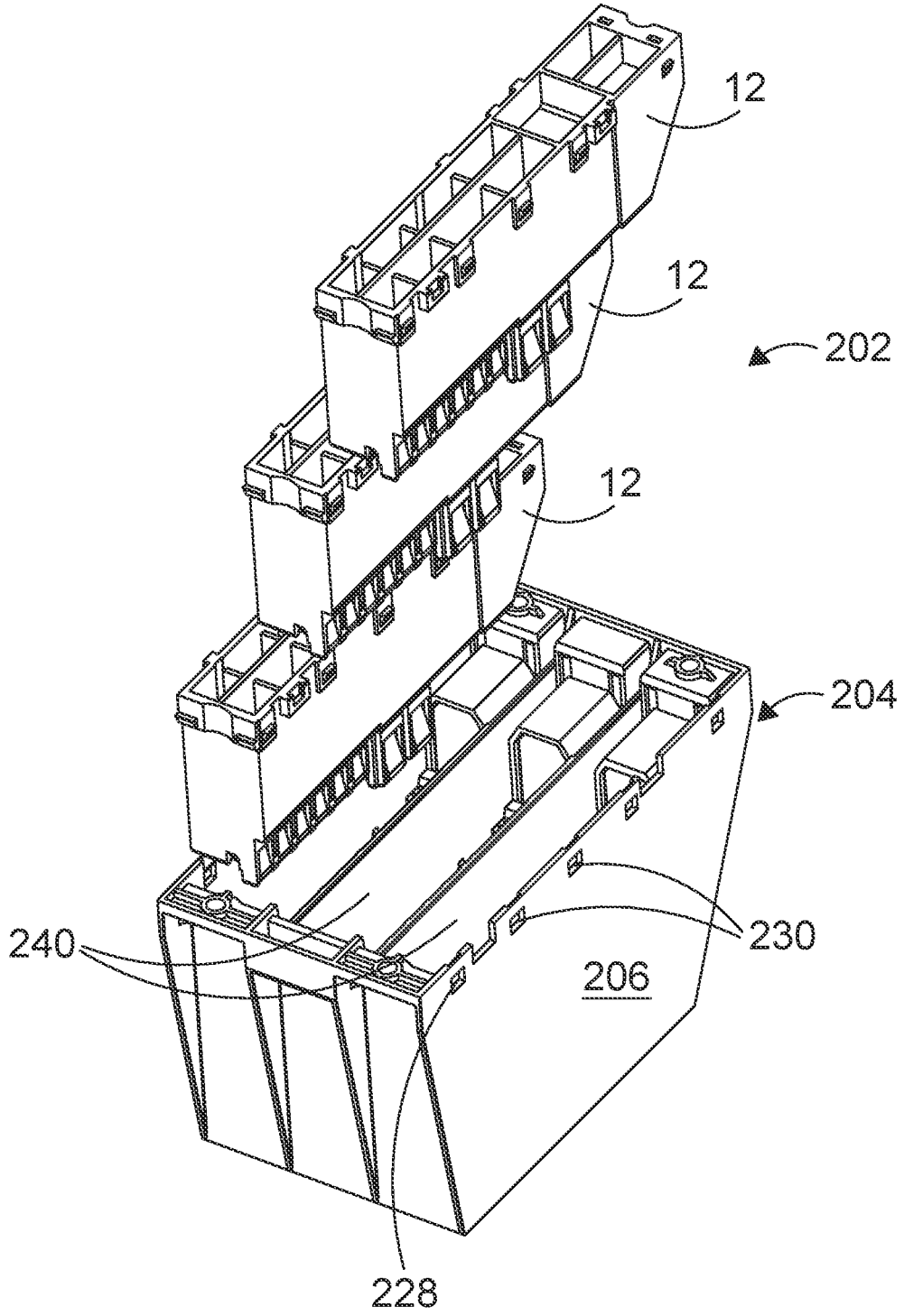
FIG. 9 is an exploded bottom front perspective view of the housing of the terminal of FIG. 5 showing three modules slices in various stages of insertion.

The inner surfaces of the outer housing side walls 206 and both surfaces of the partition walls 240 may be provided with spaced parallel guides 242 which extend between the top wall of the outer housing and the open bottom. The guides assist in positioning the module slices 12 within the associated chamber of the outer housing. FIG. 9 is an exploded bottom perspective view of the power distribution terminal of FIG. 7 showing the arrangement of the slices 12 with respect to the outer housing 204.

It should be noted in FIGS. 8 and 9 that the partition walls 240 do not extend all the way to the bottom of the outer housing. That is, the side and end walls 206, 208 extend further to the bottom opening of the outer housing than do the partition walls. This affords the accommodation of a further feature of the invention which will be described with reference to FIG. 10.

Figure 10:
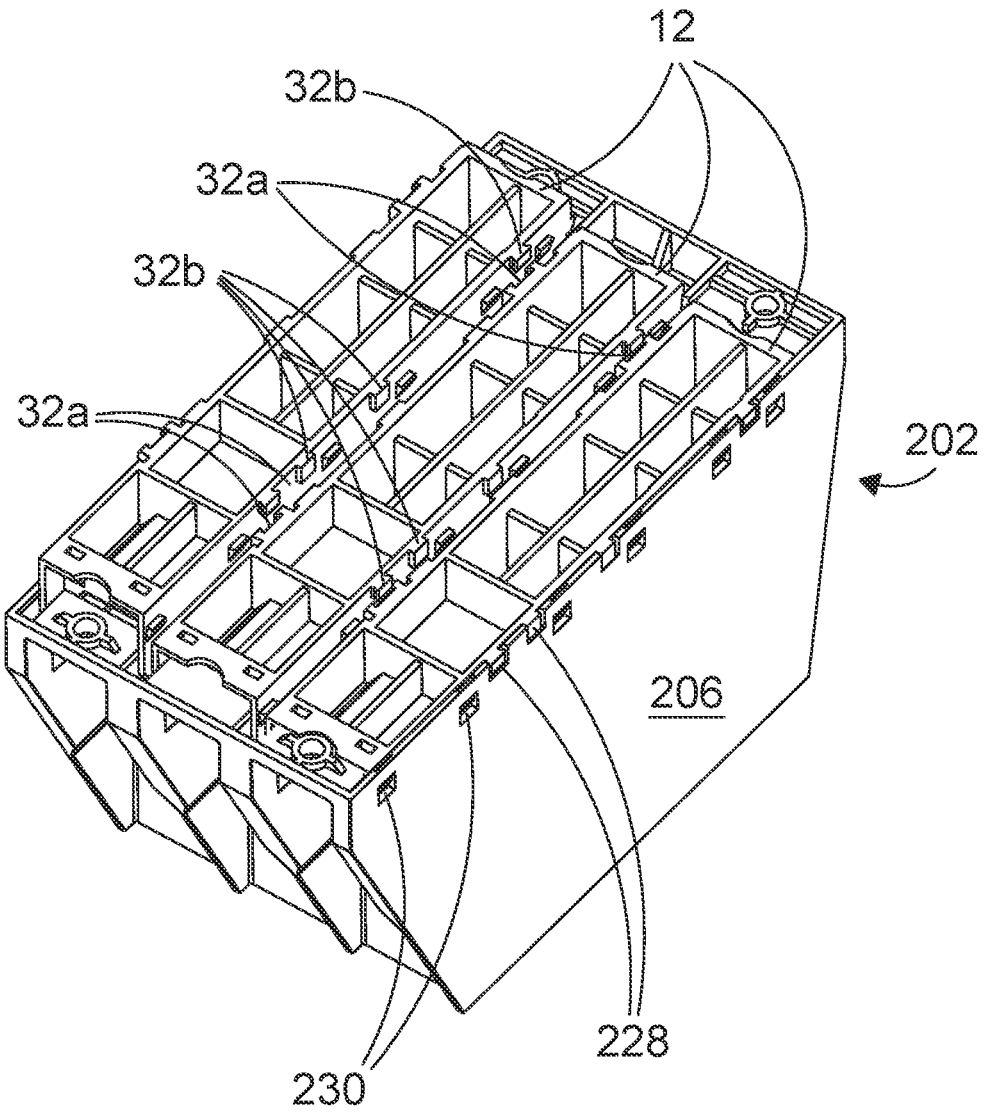
FIG. 10 is a bottom front perspective view of the housing of the terminal of FIG. 5 with three installed module slices.

More particularly, FIG. 10 is a bottom perspective view of the power distribution terminal of FIG. 7 with the module slices 12 in various stages of arrangement in the respective chambers of the outer housing. The slice 12 to the right in FIG. 10 is fully inserted into its chamber. The middle slice is partially within its chamber, and the slice to the left of FIG. 10 is further out of its chamber. Because the partition walls of the outer housing 204 do not extend to the bottom opening of the outer housing, they are not visible in FIG. 10. Yet, the gap provided at the bottom of each partition walls enables the connectors 32*a* of one slice 12 to engage the corresponding connectors 32*b* of an adjacent slice. According to a preferred embodiment, the connectors 32*a* are configured as slots and the connectors 32*b* are configured as projections, with the projections of one slice being received in corresponding slots of an adjacent slice as shown in FIG. 10. Thus, for the fully inserted slice on the right of FIG. 10, the projections 32*b* toward the right of the slice are arranged in corresponding recesses 28 of the outer housing side wall 206. At the left side of the fully inserted right slice, the projections 32*b* toward the right of the middle slice are partially inserted in corresponding slots 32*a* to the left side of the fully inserted right slice and projections on the left of the right slice are partially inserted in corresponding slots 32 to the right side of the middle slice. At the left side of the middle slice, projections 32*b* and slots 32*a* are aligned with corresponding slots 32*a* and projections 32*b*, respectively, on the right side of the left slice. When the slices 12 are all fully inserted into the outer housing, the outer housing acts as a cover for the slices 12 in a multi-slice terminal assembly.

In FIG. 10, some of the corresponding slots and projections are configured as tongue and groove connectors while other corresponding slots and projections are configured as dovetail connectors. It will be appreciated that the connectors may also be configured as all of one type or all of another type or a mixture of the two as shown.

While the preferred forms and embodiments of the invention have been illustrated and described, it will be apparent to those of ordinary skill in the art that various changes and modifications may be made without deviating from the inventive concepts set forth above.

What is claimed is:

1. A modular power distribution terminal, comprising (a) an outer housing containing a chamber having a bottom opening, said outer housing including a top wall, a pair of spaced end walls and a pair of spaced parallel side walls having first fasteners;

(b) at least one module slice arranged within said outer housing chamber, each module slice including (1) a slice housing including a pair of spaced parallel side walls having first fasteners configured for fastening with said first fasteners said outer housing side walls;

(2) a current bar connected with and extending along a length of said slice housing;

(3) an input screw connection terminal connected with said current bar; and (4) at least two output connection terminals connected with said current bar.

2. A modular power distribution terminal as defined in claim 1, wherein said current bar comprises an integral structure include a first portion for connection with said output connection terminals and a second portion arranged at an angle relative to said first portion for connection with said input screw connection terminal.

3. A modular power distribution terminal as defined in claim 1, wherein said current bar comprises a first and second portions joined together at an angle, said output terminals being connected with said first portion and said input screw connection terminal being connected with said second portion.

4. A modular power distribution terminal as defined in claim 1, wherein said current bar includes a first portion connected with said output terminals and a second portion arranged at an angle relative to said first portion and connected with said input screw connection terminal, said first portion being thicker than said second portion.

5. A modular power distribution terminal as defined in claim 1, wherein said outer housing includes at least one partition wall parallel to and spaced from said outer housing side walls to divide said outer housing chamber into separate chambers each configured to receive a module slice.

6. A modular power distribution terminal as defined in claim 5, wherein said slice housing side walls include spaced second fasteners for connection with second fasteners of an adjacent slice module.

7. A modular power distribution terminal as defined in claim 6, wherein said second fasteners comprise tongue and groove fasteners.

8. A modular power distribution terminal as defined in claim 6, wherein said second fasteners comprise dovetail fasteners.

9. A modular power distribution terminal as defined in claim 6, wherein said output connection terminals comprise push-in connectors.

10. A modular power distribution terminal as defined in claim 9, wherein said push-in connectors comprise spring elements accessible from a top orientation.

11. A modular power distribution terminal as defined in claim 10, wherein said spring elements of said at least two output terminals have different cross-sections for receiving different conductors, respectively.

12. A modular power distribution terminal as defined in claim 10, wherein said input screw connection terminal is accessible from a side orientation.

13. A modular power distribution terminal as defined in claim 10, wherein said outer housing top wall includes openings aligned with said output connection terminals, respectively, for receiving conductors for connection with said output connection terminals.

* * * * *